US011149426B2

(12) United States Patent
Nahrgang et al.

(10) Patent No.: US 11,149,426 B2
(45) Date of Patent: Oct. 19, 2021

(54) TOILET ASSEMBLY HAVING IMPROVED CLOSET FLANGE

(71) Applicant: Charlotte Pipe and Foundry Company, Charlotte, NC (US)

(72) Inventors: Gregory Eugene Nahrgang, Rock Hill, SC (US); Evan Knapp, Monroe, NC (US)

(73) Assignee: Charlotte Pipe and Foundry Company, Charlotte, NC (US)

( * ) Notice: Subject to any disclaimer, the term of this patent is extended or adjusted under 35 U.S.C. 154(b) by 0 days.

(21) Appl. No.: 16/438,610

(22) Filed: Jun. 12, 2019

(65) Prior Publication Data

US 2020/0392716 A1 Dec. 17, 2020

(51) Int. Cl.
*E03D 11/16* (2006.01)

(52) U.S. Cl.
CPC ..... *E03D 11/16* (2013.01)

(58) Field of Classification Search
USPC ..... 4/252.5
See application file for complete search history.

(56) References Cited

U.S. PATENT DOCUMENTS

| | | | |
|---|---|---|---|
| 3,118,682 | A | 5/1961 | Fredd |
| 3,376,060 | A | 12/1965 | Hiroyuki |
| 3,483,789 | A | 11/1967 | Wurzel |
| 3,677,434 | A | 7/1972 | Boyer |

(Continued)

FOREIGN PATENT DOCUMENTS

| | | | |
|---|---|---|---|
| WO | 9425786 | A1 | 11/1994 |
| WO | 2014084985 | A1 | 6/2014 |

OTHER PUBLICATIONS

The American Society of Mechanical Engineers, ASME A112.4.4.4.2017, "Plastic Push-Fit Drain, Waste, and Vent (DWV) Fittings," Date of Issuance Oct. 12, 2017, Copyright 2017, all enclosed pages cited (20 pages).

(Continued)

*Primary Examiner* — Huyen D Le
(74) *Attorney, Agent, or Firm* — Nelson Mullins Riley & Scarborough LLP

(57) ABSTRACT

A toilet assembly comprises a mounting surface defining an opening in which a waste pipe is located. The waste pipe has an end at a location no higher than flush with the mounting surface. A toilet having a drain aligned with the waste pipe is also provided. A ring gasket (e.g., a wax seal) has at least a portion situated around the drain of the toilet. A closet flange has a tubular portion having a proximal end and a distal end and a flange portion located at the proximal end of the tubular portion. The flange portion is connected to the mounting surface. The end of the waste pipe is received in the tubular portion of the closet flange such that an outer surface of the waste pipe is adjacent to an inner surface of the tubular portion. A seal ring is disposed between the inner surface of the tubular portion and the outer surface of the waste pipe. A locking structure is carried by the tubular portion of the closet flange, the locking structure including a plurality of inner edge portions spaced circumferentially about the inner surface of the tubular portion and engaging the outer surface of the waste pipe so as to inhibit axial separation of the closet flange and waste pipe.

23 Claims, 7 Drawing Sheets

(56) References Cited

U.S. PATENT DOCUMENTS

| | | | | |
|---|---|---|---|---|
| 3,829,227 | A | 8/1974 | Derman | |
| 3,856,050 | A | 12/1974 | Rooney | |
| 3,924,882 | A | 12/1975 | Ellis | |
| 3,942,681 | A | 3/1976 | Richardson | |
| 3,996,966 | A | 12/1976 | Princell | |
| 4,014,368 | A | 3/1977 | Nelsen | |
| 4,073,514 | A | 2/1978 | Pate | |
| 4,084,843 | A | 4/1978 | Gassert | |
| 4,146,254 | A | 3/1979 | Tuner et al. | |
| 4,212,486 | A | 7/1980 | Logsdon | |
| 4,233,697 | A | 11/1980 | Cornwall | |
| 4,384,910 | A * | 5/1983 | Prodyma | E03D 11/14 156/294 |
| 4,586,734 | A | 5/1986 | Grenier | |
| 4,600,223 | A | 7/1986 | de Vries | |
| 4,602,504 | A | 7/1986 | Barber | |
| 4,706,482 | A | 11/1987 | Barber | |
| 4,747,626 | A | 5/1988 | Hama et al. | |
| 4,763,510 | A | 8/1988 | Palmer | |
| 4,915,137 | A | 4/1990 | Hall et al. | |
| 5,029,908 | A | 7/1991 | Belisaire | |
| 5,265,752 | A | 11/1993 | Olson | |
| 5,329,971 | A | 7/1994 | Condon | |
| 5,377,361 | A | 1/1995 | Piskula | |
| D355,958 | S | 2/1995 | Teskey | |
| 5,503,189 | A | 4/1996 | Lamendola | |
| 5,527,073 | A | 6/1996 | Readman | |
| 5,603,530 | A | 2/1997 | Guest | |
| 5,624,123 | A | 4/1997 | Meyers | |
| 5,681,062 | A | 10/1997 | Fukao et al. | |
| 5,692,784 | A | 12/1997 | Hama et al. | |
| 5,695,224 | A | 12/1997 | Grenier | |
| 5,711,536 | A | 1/1998 | Meyers | |
| 5,996,134 | A | 12/1999 | Senninger | |
| RE36,630 | E | 3/2000 | Davey | |
| 6,032,515 | A | 3/2000 | Huber | |
| 6,052,839 | A | 4/2000 | Teskey | |
| 6,085,362 | A | 6/2000 | Huber | |
| 6,231,090 | B1 | 5/2001 | Fukao et al. | |
| 6,416,084 | B1 | 7/2002 | Mantyla | |
| 6,464,266 | B1 | 10/2002 | O'Neill et al. | |
| 6,488,319 | B2 | 12/2002 | Jones | |
| 6,499,771 | B1 | 12/2002 | Snyder, Sr. et al. | |
| 6,719,330 | B2 | 4/2004 | Brown et al. | |
| 6,739,597 | B2 | 5/2004 | Nicolia et al. | |
| 6,915,819 | B2 | 7/2005 | Duncan | |
| 7,055,184 | B2 | 6/2006 | Humber | |
| 7,055,829 | B2 | 6/2006 | Russell | |
| 7,316,429 | B2 | 1/2008 | Viegener | |
| 7,341,286 | B2 | 3/2008 | Andre | |
| 7,343,936 | B2 | 3/2008 | Collins et al. | |
| 7,448,654 | B2 | 11/2008 | Le Quere | |
| 7,665,486 | B2 | 2/2010 | Coscarella | |
| 7,841,630 | B1 | 11/2010 | Auray et al. | |
| 8,069,502 | B2 | 12/2011 | Coronado | |
| 8,099,801 | B2 | 1/2012 | Hughes | |
| 8,118,091 | B2 | 2/2012 | Baker et al. | |
| 8,245,732 | B2 | 8/2012 | Coscarella | |
| 8,281,421 | B2 | 10/2012 | Hughes | |
| 8,443,844 | B2 | 5/2013 | Zeyfang | |
| 8,474,877 | B2 | 7/2013 | Smith | |
| 8,646,314 | B2 | 2/2014 | Coscarella | |
| 8,671,991 | B2 | 3/2014 | Zeyfang | |
| 8,801,048 | B2 | 8/2014 | Morris et al. | |
| 8,898,823 | B2 | 12/2014 | McHugh, III | |
| 9,068,678 | B2 * | 6/2015 | Whitehead | F16L 23/024 |
| 9,074,377 | B2 | 7/2015 | Wood | |
| 9,091,076 | B2 | 7/2015 | Amer et al. | |
| 9,249,586 | B2 | 2/2016 | Wood | |
| 9,506,258 | B2 | 11/2016 | Amer et al. | |
| 9,568,127 | B2 | 2/2017 | Morris et al. | |
| 9,816,261 | B2 | 11/2017 | Schuster | |
| 9,869,081 | B1 | 1/2018 | Pardo, Jr. | |
| 9,970,587 | B2 | 5/2018 | Armenta | |
| 10,041,242 | B2 | 8/2018 | Yssel | |
| 2002/0185868 | A1 | 12/2002 | Snyder et al. | |
| 2003/0159203 | A1 | 8/2003 | Hoover | |
| 2006/0214422 | A1 | 9/2006 | Cuvo et al. | |
| 2009/0243288 | A1 | 10/2009 | O'Neil et al. | |
| 2010/0123307 | A1 * | 5/2010 | Coronado | E03D 11/16 285/56 |
| 2011/0140417 | A1 | 6/2011 | Kluss et al. | |
| 2012/0217742 | A1 | 8/2012 | Furuya et al. | |
| 2012/0261024 | A1 | 10/2012 | Ketzer | |
| 2013/0106104 | A1 | 5/2013 | Le Quere | |
| 2015/0000019 | A1 * | 1/2015 | Connell | E03D 11/16 4/252.4 |
| 2017/0237243 | A1 | 8/2017 | Brey | |
| 2018/0142456 | A1 | 5/2018 | Condon et al. | |
| 2018/0252344 | A1 | 9/2018 | Morris et al. | |
| 2018/0347171 | A1 * | 12/2018 | Connell | E03D 11/16 |

OTHER PUBLICATIONS

International Code Council, 2018 International Plumbing Code General Regulations Section 311 and Section 312, Copyright 2017 (1 page).

PCT International Search Report for International Application No. PCT/US2013/066029. (9 pages).

Https://www.canplas.com/plumbing/product_category/easy-open-closet-flanges, date-stamped and as printed on Nov. 20, 2020, Copyright 2020. (one page).

* cited by examiner

TOILET ASSEMBLY HAVING IMPROVED CLOSET FLANGE

BACKGROUND OF THE INVENTION

The present invention relates generally to household toilets. More particularly, the present invention relates to installation of a toilet utilizing a closet flange.

A "closet flange" (sometimes called a "toilet flange") is used to connect and secure a toilet to a building's plumbing system. Generally, closet flanges have a radial flange portion located at the proximal end of a tubular portion. Typically, closet flanges are produced from metals such as cast iron or brass, or plastics such as polyvinyl chloride (PVC) or acrylonitrile butadiene styrene (ABS).

Plastic closet flanges are bolted to the floor/subfloor of the building in alignment with the end of a waste pipe. The tubular portion of the closet flange is commonly attached to the waste pipe using solvent cement to chemically weld the closet flange and the waste pipe together. There are closet flanges in the market that are of the push-on type that do not require solvent cement. These flanges typically go on the inside of the waste pipe, thereby reducing the pipe's inner diameter which could lead to a blockage of the plumbing system.

SUMMARY OF THE INVENTION

The present invention recognizes and addresses the foregoing considerations, and others, of prior art constructions and methods.

According to one aspect, the present invention provides a toilet assembly comprising a mounting surface defining an opening in which a waste pipe is located. The waste pipe has an end at a location no higher than flush with the mounting surface. A toilet having a drain aligned with the waste pipe is also provided. A ring gasket (e.g., a wax seal) has at least a portion situated around the drain of the toilet.

This aspect further includes a closet flange with a tubular portion having a proximal end and a distal end and a flange portion located at the proximal end of the tubular portion. The flange portion is connected to the mounting surface. The end of the waste pipe is received in the tubular portion of the closet flange such that an outer surface of the waste pipe is adjacent to an inner surface of the tubular portion. A seal ring is disposed between the inner surface of the tubular portion and the outer surface of the waste pipe. A locking structure is carried by the tubular portion of the closet flange, the locking structure including a plurality of inner edge portions spaced circumferentially about the inner surface of the tubular portion and engaging the outer surface of the waste pipe so as to inhibit axial separation of the closet flange and waste pipe.

According to another aspect, the present invention provides a closet flange for use in installation of a toilet in relation to a waste pipe. The closet flange of this aspect comprises a unitary body formed of polymeric material (e.g., polyvinyl chloride), the body including a tubular portion having a proximal end and a distal end and a flange portion located at the proximal end of the tubular portion. The flange portion extends radially outward with respect to the tubular portion of the unitary body and defines a plurality of openings therethrough for use in securing the closet flange to a mounting surface. A seal ring is disposed on an inner surface of the tubular portion to provide sealing engagement between the inner surface of the tubular portion and an outer surface of the waste pipe. A locking structure is carried by the tubular portion of the closet flange, the locking structure including a plurality of inner edge portions spaced circumferentially about the inner surface of the tubular portion and engaging the outer surface of the waste pipe so as to inhibit axial separation of the closet flange and waste pipe.

According to an exemplary embodiment, the locking structure comprises a locking ring (e.g., formed of stainless steel or other metal) that defines the plurality of inner edge portions. For example, the locking ring may include a plurality of corrugations extending circumferentially thereabout, the corrugations presenting the inner edge portions and outer edge portions engaging the inner surface of the tubular portion of the closet flange. In this regard, the locking ring may preferably have a generally frusto-conical shape with the corrugations extending at a conical angle of between about five degrees (5°) and about twenty-five degrees (25°)(such as about fifteen degrees (15°) in one preferred embodiment).

According to an exemplary embodiment, the locking structure may comprise a support element connected to the tubular portion of the unitary body, the support element being in assembly with the locking ring so as to support the locking ring in a predetermined disposition. The support element may have an annular configuration and may comprise a plurality of support fingers spaced apart circumferentially thereabout, the locking ring being interwoven with the support fingers with the corrugations alternatingly disposed inwardly and outwardly of the support fingers. The tubular portion of the unitary body may have a plurality of arcuate extensions received in corresponding slots defined in the support element to connect said support element and the tubular portion.

According to an exemplary embodiment, the flange portion of the body may define a pair of diametrically-opposed arcuate slots for receipt of a respective toilet bolt, the slots each having a widened insertion portion and a narrow retaining portion.

A still further aspect of the present invention provides a closet flange for use in installation of a toilet in relation to a waste pipe. The closet flange comprises a unitary body formed of polymeric material, the body including a tubular portion having a proximal end and a distal end and a flange portion located at the proximal end of the tubular portion. The flange portion extends radially outward with respect to the tubular portion of the unitary body and defines a plurality of openings therethrough for use in securing the closet flange to a mounting surface. The flange portion further defines a pair of diametrically-opposed arcuate slots for receipt of a respective toilet bolt, the slots having a widened insertion portion and a narrow retaining portion. A seal ring is disposed on a surface of the tubular portion to provide sealing engagement with a surface of the waste pipe. A locking structure is carried by the tubular portion of the closet flange, the locking structure including a locking ring defining a plurality of edge portions spaced circumferentially about the surface of the tubular portion and engaging the surface of the waste pipe so as to inhibit axial separation of the closet flange and waste pipe.

According to an exemplary embodiment, an inner surface of the tubular portion of the unitary body has a smaller inner diameter proximal portion and a larger inner diameter distal portion, the seal ring and the locking ring being positioned at the distal portion so as to engage an outer surface of the waste pipe.

A still further aspect of the present invention provides a method of installing a toilet to a mounting surface defining an opening at which an end of a waste pipe is located. One step of the method involves providing a closet flange including a tubular portion having a proximal end and a distal end and a flange portion located at the proximal end of the tubular portion. A seal ring and a locking ring are disposed on an inner surface of the tubular portion, the locking ring defining a plurality of inner edge portions spaced circumferentially about the inner surface of the tubular portion.

Another step of the method involves slidably positioning the tubular portion of the closet flange on an outer surface of the waste pipe until the flange portion engages the mounting surface such that the seal ring and the edge portions of the locking ring engage the outer surface of the waste pipe to inhibit axial separation of the closet flange and the waste pipe. According to a further step, the flange portion of the closet flange is secured to the mounting surface. Another step involves positioning a ring gasket at a drain opening defined in the flange portion of the closet flange. The toilet is positioned with respect to the mounting surface such that a drain of the toilet will be circumscribed by the ring gasket.

These and other novel aspects, features and advantages of the present invention will be apparent from the following disclosure of a preferred embodiment of the invention as depicted in the accompanying drawings.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
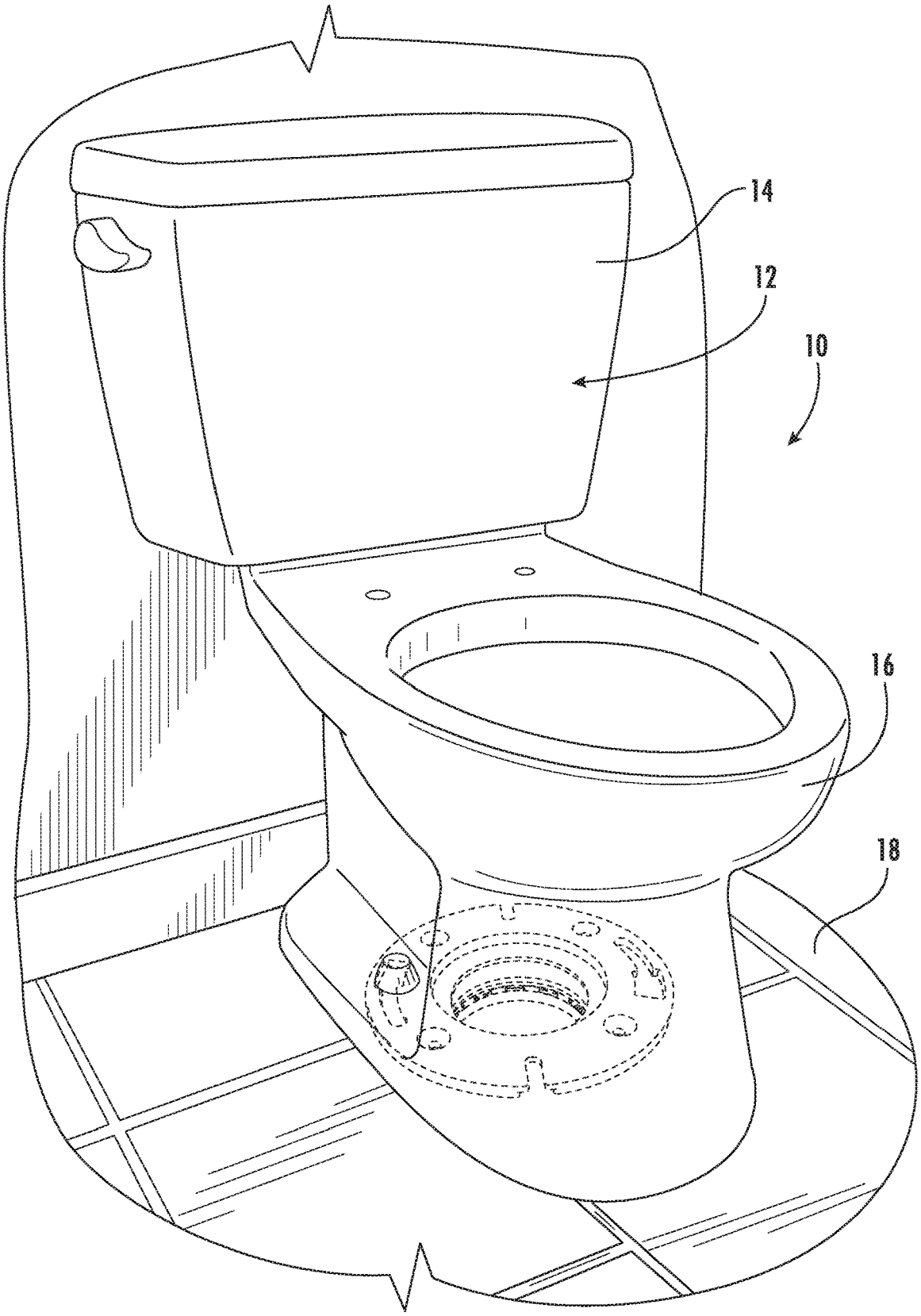
FIG. 1 is a perspective view showing a toilet assembly utilizing an improved closet flange in accordance an embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, any usage of the terms "coupling," "fitting," "socket," "pipe," and the "end" of a pipe are intended to be understood and interpreted, in their broadest generic sense not inconsistent with but not limited to any common industry usage. A "pipe" is used herein to encompass any tubular structure capable of fluid conveyance therethrough and an "end" of a pipe is any termination of the tubular structure defining an opening through which fluid enters or exits the pipe. A "pipe" may be linear (straight) or non-linear (e.g., curvilinear) in the direction of fluid conveyance, and may be of differing transverse cross-sectional shapes, often round but not necessarily cylindrical or uniform in transverse cross-section. Pipes include for example tubular structures with uniform inner and outer diameters defining a cylindrical tubular structure, as are often commonly referred to as pipes, but also include other tubular components.

Figure 2:
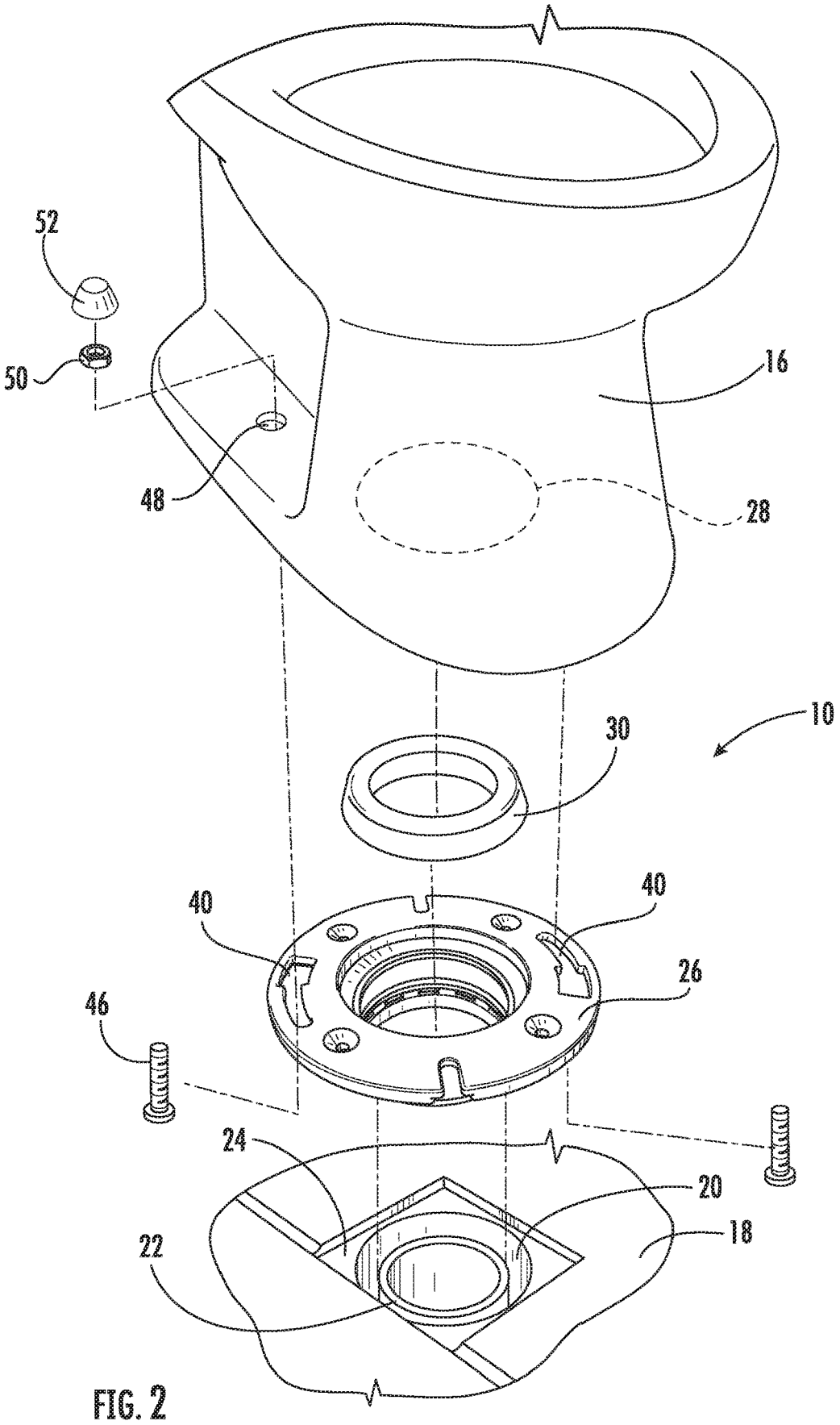
FIG. 2 is a perspective exploded view of the toilet assembly of FIG. 1 showing various component parts including the improved closet flange.

FIGS. 1 and 2 illustrate a toilet assembly 10 in accordance with an embodiment of the present invention. As shown, assembly 10 includes a toilet 12 which is in this example a conventional two-piece toilet having a tank 14 and a base 16. Base 16 is secured to a floor 18, such as in the bathroom of a residence. As can be seen most clearly in FIG. 2, floor 18 defines a hole 20 exposing the end of a waste pipe 22. In this example, floor 18 is tiled and the end of waste pipe 22 is cut to be flush with or slightly below the subfloor 24. Note that the hole 20 provides an annular gap around the outer surface of waste pipe 22. A closet flange 26 is secured to floor 18 (or to subfloor 24), typically using bolts, in order to interface the drain 28 of toilet 12 with waste pipe 22. A seal gasket 30, e.g., a conventional wax seal, is located between toilet 12 and closet flange 26 to seal the space therebetween. At least a portion of seal gasket 30 is located around (i.e., circumscribes) the drain 28.

Figure 3:
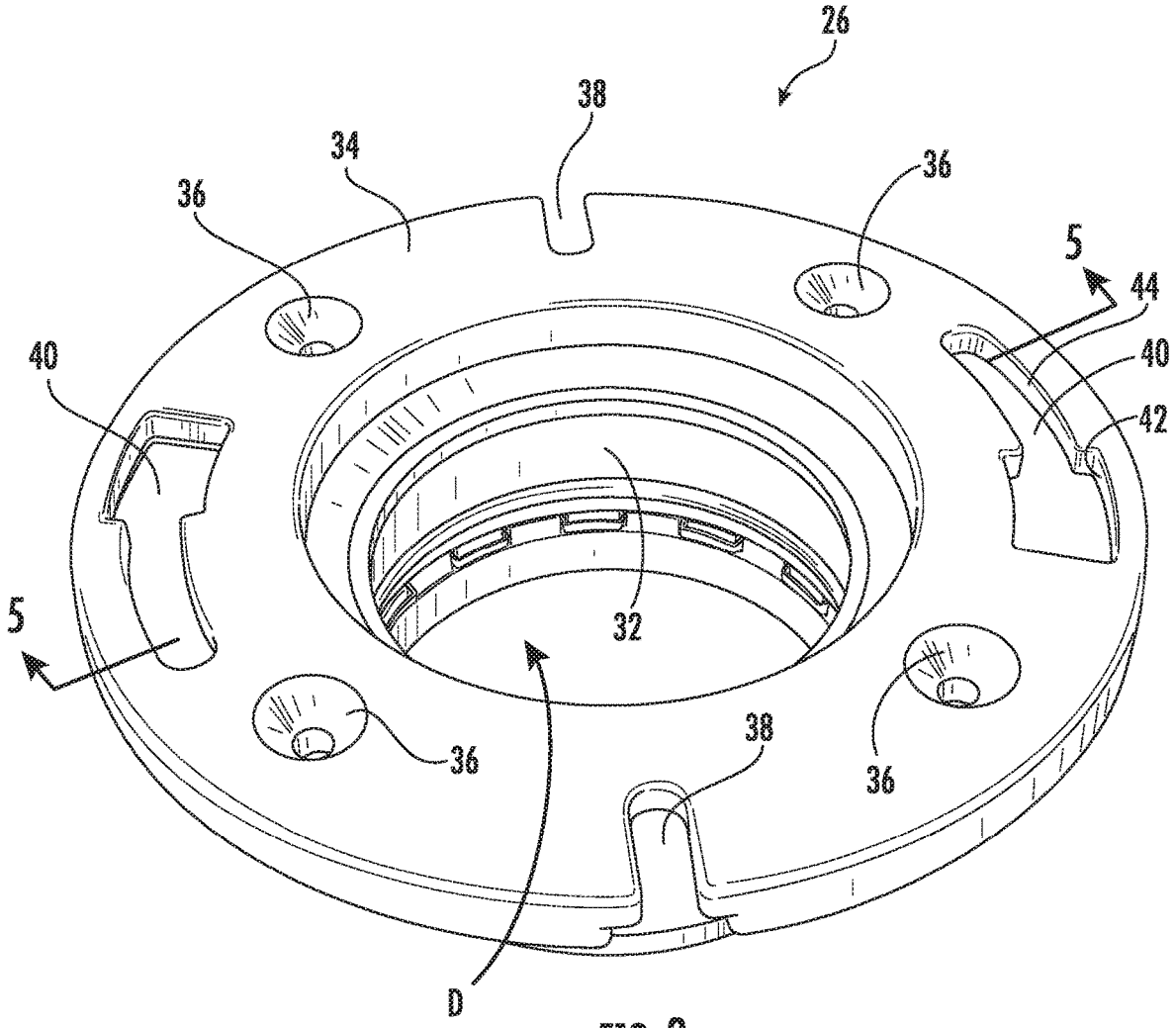
FIG. 3 is a perspective view of an improved closet flange in accordance with an embodiment of the present invention.

Referring now also to FIG. 3, the body of closet flange 26 has a tubular portion 32 (which also be called a "hub portion") with a proximal end and a distal end. A flange portion 34 is located at and extends radially from the proximal end of tubular portion 32. Together, tubular portion 32 and flange portion 34 define a drain opening D. It will be appreciated that the body of closet flange 26 may be formed of any suitable material. In this embodiment, for example, the body of closet flange 26 is unitarily formed from PVC.

The inner diameter of tubular portion 32 is sized to receive the end of waste pipe 22. Thus, when closet flange 26 is installed, tubular portion 32 is inserted into the gap of hole 20 surrounding the outer surface of waste pipe 22. Flange portion 34 preferably defines openings, such as holes 36 and/or slots 38, for receipt of fasteners (e.g., bolts) for securing closet flange 26 to the mounting surface (i.e., floor 18 in this case).

Flange portion 34 further defines two diametrically-opposed arcuate slots 40, each having a widened insertion 42 and a narrower retention portion 44. As can be explained most easily with reference to FIG. 2, widened insertion portion 42 allows the head of a respective toilet bolt 46 to be inserted into slot 40. The toilet bolt is then moved along slot 40 until the bolt head is position under and retained by retention portion 42. Toilet 12 is positioned such that the shanks of toilet bolts 46 extend through respective lateral holes (e.g., hole 48) in the base 16 of the toilet 12. Washers and nuts (e.g., nut 50) are used to secure toilet 12 with respect to closet flange 26. The ends of toilet bolts 46 may be covered with a decorative cap such as cap 52.

Figure 4:
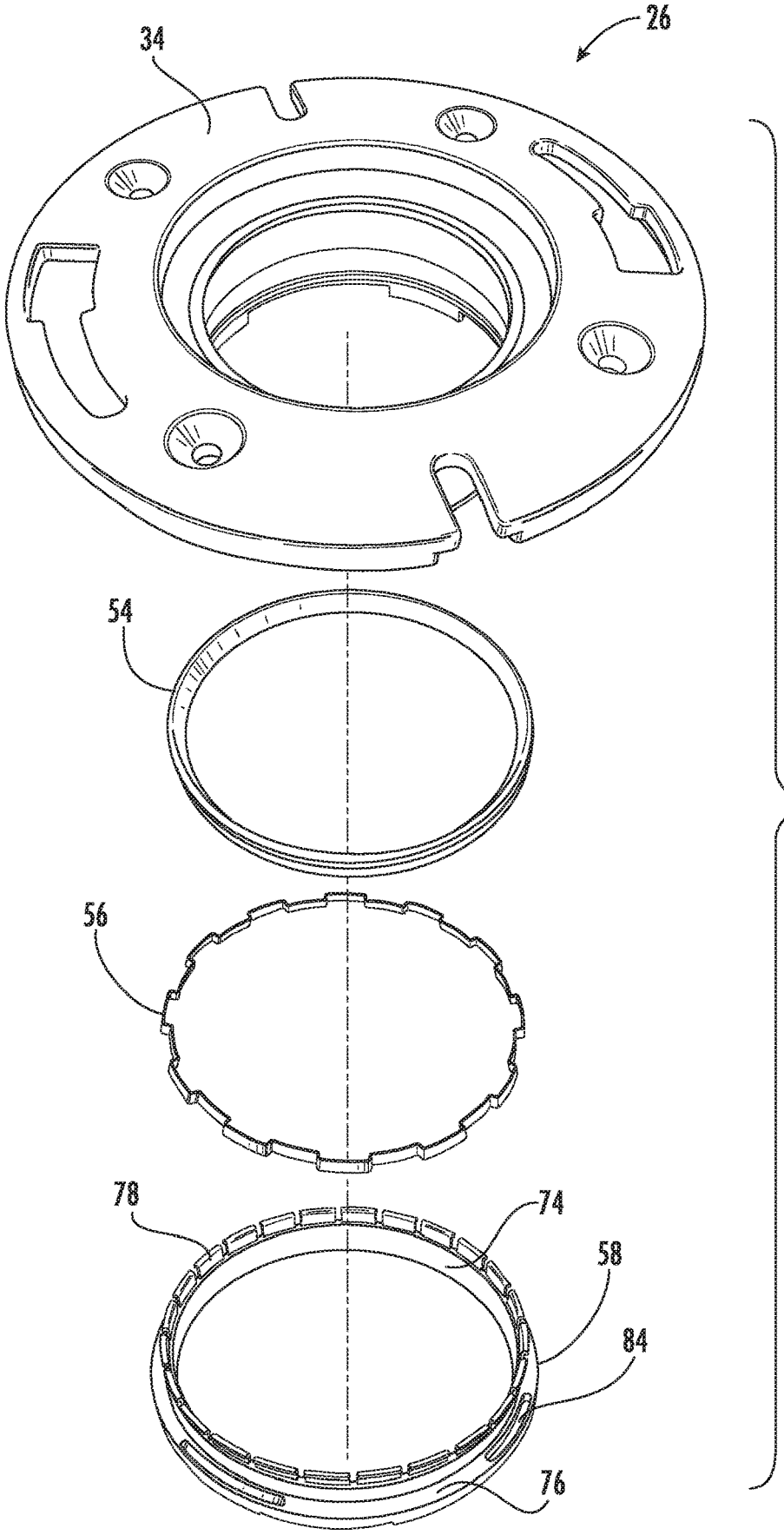
FIG. 4 is a perspective exploded view of the closet flange of FIG. 3.
Figure 5:
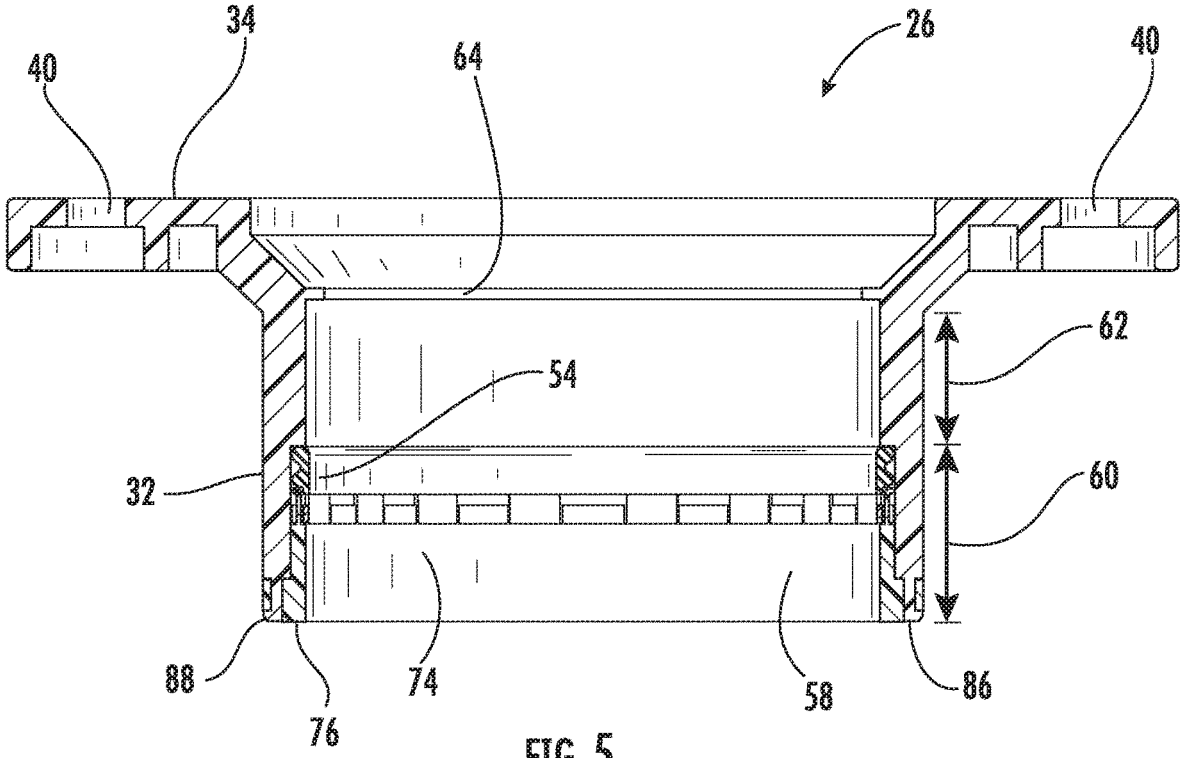
FIG. 5 is a cross-sectional view taken along line 5-5 of FIG. 3.
Figure 6:
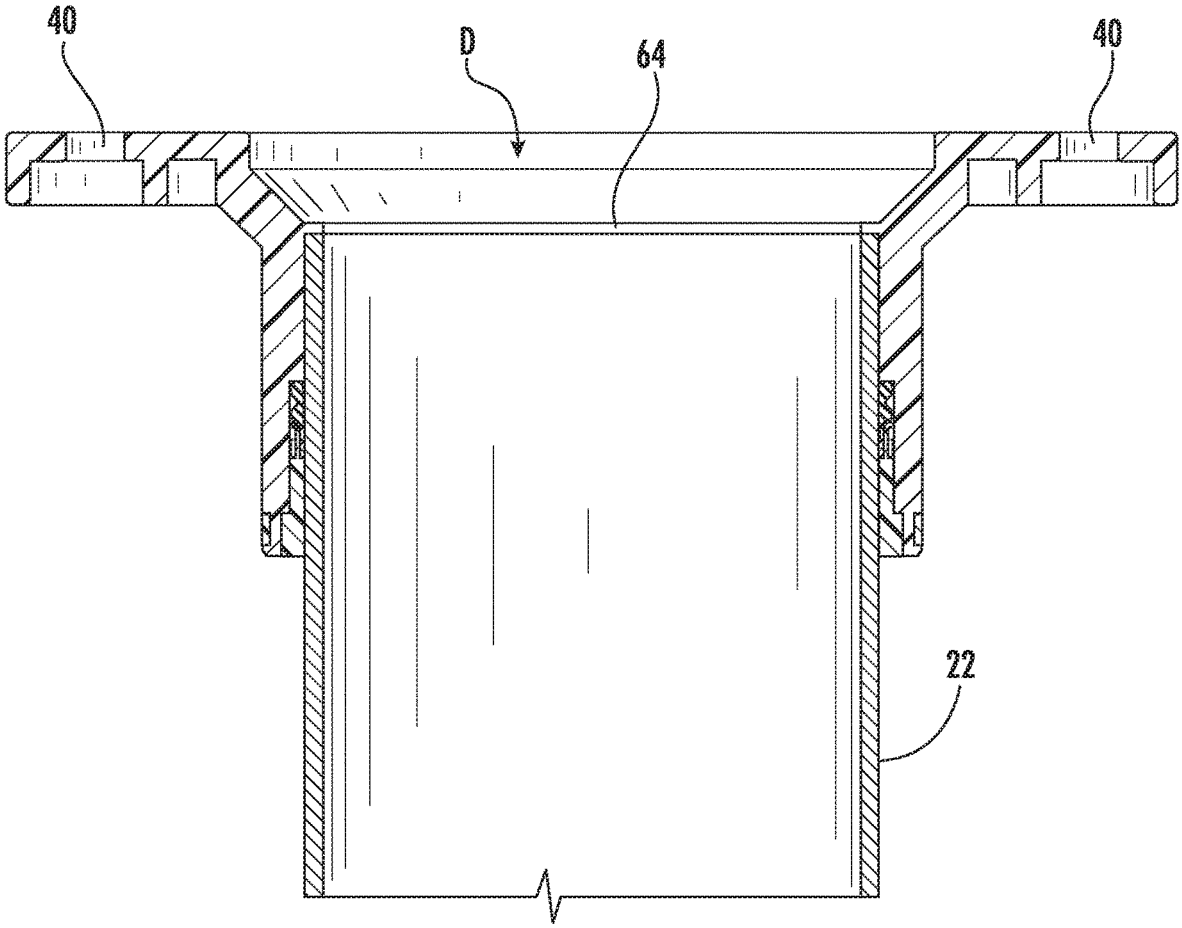
FIG. 6 is a view similar to FIG. 5 but showing the closet flange installed on a bathroom waste pipe.

Referring now to FIGS. 4 through 6, certain additional details of closet flange 26 can be most easily explained. Closet flange 26 is advantageously configured to seal with the outer surface of waste pipe 22 and inhibit axial separation with waste pipe 22 after installation. Toward this end, the illustrated embodiment includes a seal ring 54 and a locking ring 56 maintained in position by an annular support element 58. As shown in FIG. 5, seal ring 54 and locking ring 56 are in this case seated in a larger inner diameter distal portion 60 of tubular portion 32. Seal ring 54 abuts an inward step formed by the transition to a smaller inner diameter of a proximal portion 62 of tubular portion 32. As shown in FIG. 6, tubular portion 32 further defines a stop 64 extending radially inwardly into the drain opening D to limit the insertion of waste pipe 22.

Seal ring 54, which may be formed of rubber or other suitable elastomeric material, preferably has at least a portion with an inner diameter slightly smaller that the outer diameter of waste pipe 22. For example, the inside surface of seal ring 54 may be sloped from a distal inner diameter slightly greater than the waste pipe's outer diameter to a proximal inner diameter slightly smaller than the outer diameter of waste pipe 22. This configuration facilitates installation of closet flange 26 by allowing seal ring 54 to expand as closet flange 26 is installed. As a result, seal ring 54 will snugly engage the waste pipe's outer surface to provide a good seal.

Figure 7:
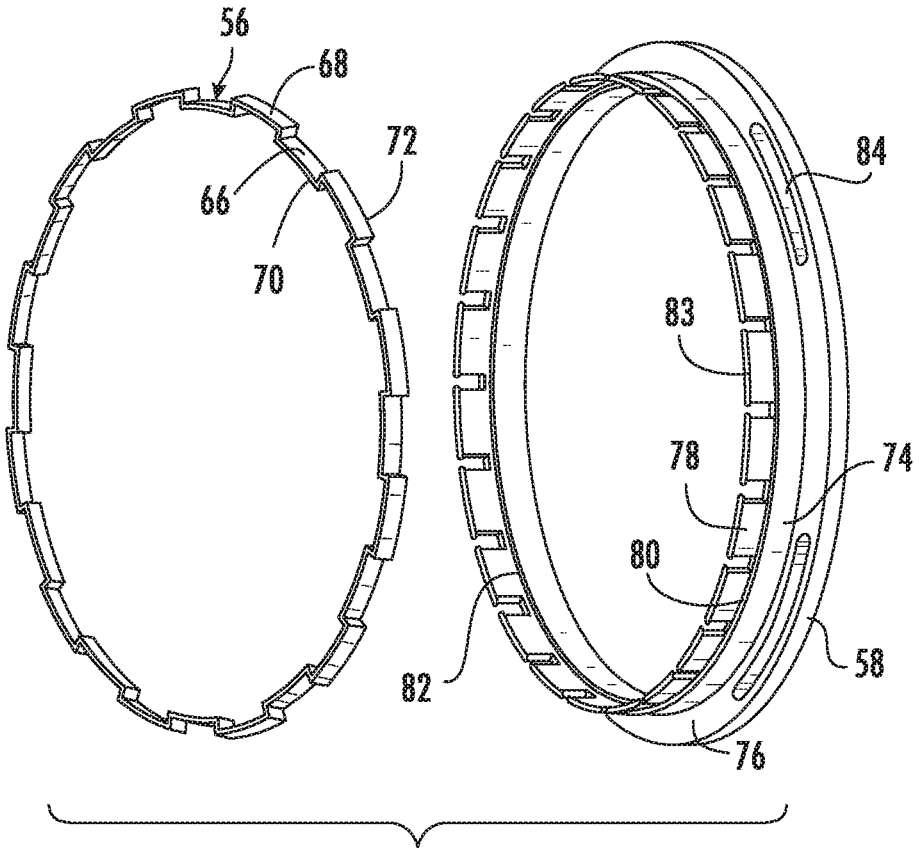
FIG. 7 is an exploded perspective view of a locking ring and support element in accordance with an embodiment of the present invention.
Figure 8:
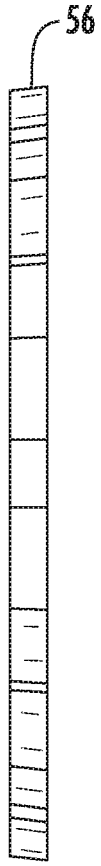
FIG. 8 is a side elevation of the locking ring of FIG. 7.
Figure 9:
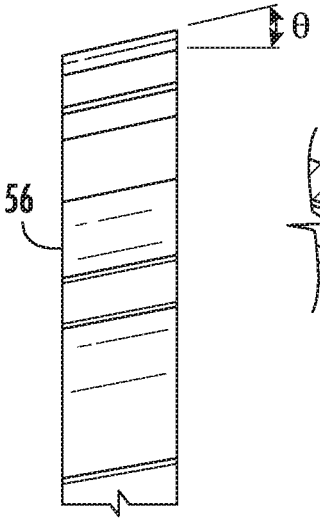
FIG. 9 is an enlarged fragmentary side elevation showing a portion of the locking ring of FIG. 7.

Referring now also to FIGS. 7 through 9, locking ring 56 is in this example formed as an annular corrugated band, preferably made of a flat strip of metal (e.g., stainless steel) fashioned into a uniformly corrugated configuration presenting a plurality of inner and outer squared corrugations 66, 68, respectively, alternating circumferentially at regular spacings about the full annular extent of the locking ring 56. However, as persons of skill in the art will recognize and understand, other corrugated, castellated or undulating configurations of the band are also contemplated to be possible. The locking ring 56 is preferably formed into a frusto-conical configuration in side-elevation, as seen in FIG. 8, with the spaced-apart outer corrugations 68 collectively extending within a common conical frustum and, likewise, with the space-apart inner corrugations 66 collectively extending within a smaller common conical frustum of lesser diametric dimensions. Optionally, the inner and outer edges 70, 72, respectively, of the locking ring 56 may be sharpened.

The diameter of the locking ring 56 as measured across the inner edge 70 between opposed inner corrugations 66 has a diameter substantially the same as or slightly less than the outer diameter of the annular outer surface of the waste pipe 22. The diameter of the locking ring 56 as measured across the outer edge 72 between opposed outer corrugations 68 has a diameter substantially the same as or slightly greater than the inner diameter of the distal portion 60 of tubular portion 32. The metal or other material out of which the locking ring 56 is fabricated should preferably provide a spring-like character imparting a degree of resiliency in the diametric direction, allowing the locking ring 56 to be fitted into the distal portion 60 with the outer edge 72 at the outer corrugations 68 in contact with the inner surface of the tubular portion 32. When closet flange 26 is installed, the inner edge 70 at the inner corrugations 66 will similarly be in contact with the outer surface of the waste pipe 22 (as shown in FIG. 6).

Referring now specifically to FIG. 9, it is contemplated that the conical taper angle θ of the locking ring 56 may vary within a relatively wide range. The specific conical angle may be selected to provide differing performance characteristics within the locking ring 56, depending upon various parameters, such as the material of the waste pipe 22 and the closet flange 26, the diameter of the pipe 22 and the tubular portion 32, etc. Without limiting the generality of the foregoing, it is presently contemplated that the conical taper angle for the locking ring 56 should be between about 5 degrees and about 25 degrees, and may preferably be about 15 degrees. Due to the spring character of the locking ring 56, the locking ring 56 yields to the waste pipe 22 causing the inner edges 70 at the inner corrugations 66 of the locking ring 56 to engage with the outer surface of the waste pipe 22. Any force tending to cause axial separation of waste pipe 22 from closet flange 26 will cause inner edges 70 to further engage the outer surface of waste pipe 22 and outer edges 72 to further engage the inner surface of tubular portion 32. Thus, axial separation of the waste pipe 22 from closet flange 26 is inhibited.

Advantageously, the described non-penetrating engagement between the locking ring 56 and the waste pipe 22 also facilitates the separation and disassembly of the closet flange 26 from waste pipe 22 when and if desired or necessary. A twisting rotation of the closet flange 26 relative to the waste pipe 22 accompanied by simultaneous application of a gradual upward withdrawal force permits the closet flange 26 to be gradually separated from waste pipe 22.

Referring again to FIGS. 4 and 5, support element 58 has a central cylindrical main body portion 74 with an enlarged lip 76 projecting radially outwardly from one axial end of the main body portion 74. A plurality of support fingers 78 project axially from the other axial end of the main body portion 74 at regular circumferential spacings thereabout. Each of the support fingers 78 is generally rectangular in shape with an arcuate curvature in the direction of the circumference of the support element 58. As shown in FIG. 7, the main body portion 74 of the support element 58 forms a radially outer annular shoulder 80 and a radially inner annular shoulder 82 adjacent each of the support fingers 78. In addition, the axially outwardmost edge of each support finger 78 is formed with a lip 83 in facing relation to the shoulder 80.

Figure 10:
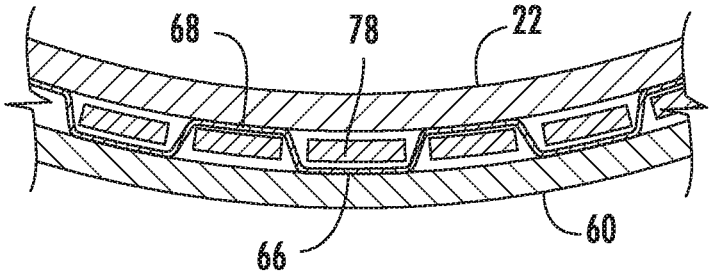
FIG. 10 is a partial axial cross-section showing assembly of the support element and locking ring of FIG. 7.

Referring now also to FIG. 10, locking ring 56 is assembled with the support element 58, with the corrugations 66, 68 of the locking ring 56 alternatingly interwoven with the support fingers 78 of the support element 58, i.e., with the inner corrugations 66 situated radially inwardly of alternate support fingers 78 and the outer corrugations 68 situated radially outwardly of the intervening support fingers 78. As one skilled in the art will appreciate, the outer corrugations 68 are contained between the shoulder 80 of the main body portion 74 and the lips 83 of such intervening support fingers 78. In such assembled condition, and prior to assembly with the tubular portion 32 of closet flange 26, the locking ring 56 is held in a relaxed non-tensioned condition by the support element 58, with the inner edges 70 of the corrugations 66 protruding slightly radially inwardly beyond the main body portion 74 and with the outer edges 72 of the corrugations 68 protruding slightly radially outwardly beyond the main body portion 74.

As shown most clearly in FIGS. 4 and 7, lip 76 of support element 58 defines a series of arcuate slots 84 spaced apart about its periphery. The slots 84 receive a respective arcuate extension 86 (FIG. 5) formed at the distal end of tubular portion 32. Once lip 76 engages the end of tubular portion 32 between the extensions 86, the extensions 86 will maintain support element 58 (carrying locking ring 56) in position. Preferably, the extensions 86 will have a respective lip 88 extending radially outwardly to lock support element 58 with respect to tubular portion 32.

U.S. Pub. App. No. 2018/0252344 is incorporated herein by reference in its entirety for all purposes.

Those skilled in the art will readily understand that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications, and equivalent arrangements, the present invention being limited only by the claims appended hereto and equivalents thereof.

What is claimed is:

1. A toilet assembly comprising:

a mounting surface defining an opening;

a waste pipe located in said opening of said mounting surface, said waste pipe having an end at a location no higher than flush with said mounting surface;

a toilet having a drain aligned with said waste pipe;

a ring gasket having at least a portion situated around said drain of said toilet; and a closet flange including:

a tubular portion having a proximal end and a distal end;

a flange portion located at said proximal end of said tubular portion, said flange portion being connected to said mounting surface;

said end of said waste pipe being received in said tubular portion of said closet flange such that an outer surface of said waste pipe is adjacent to an inner surface of said tubular portion;

a seal ring disposed between said inner surface of said tubular portion and said outer surface of said waste pipe, and a locking structure carried by said tubular portion of said closet flange, said locking structure including a plurality of inner edge portions spaced circumferentially about said inner surface of said tubular portion and engaging the outer surface of the waste pipe so as to inhibit axial separation of the closet flange and waste pipe;

wherein said locking structure comprises a locking ring that defines said plurality of inner edge portions, and said locking ring includes a plurality of corrugations extending circumferentially thereabout, the corrugations presenting said inner edge portions and outer edge portions engaging the inner surface of the tubular portion of the closet flange.

2. The toilet assembly as set forth in claim 1, wherein said locking ring has a generally frusto-conical shape.

3. The toilet assembly as set forth in claim 1, wherein said locking structure comprises a support element connected to said tubular portion of said closet flange, said support element being in assembly with said locking ring so as to support said locking ring in a predetermined disposition.

4. The toilet assembly as set forth in claim 3, wherein said support element comprises a plurality of support fingers spaced apart circumferentially thereabout, the locking ring being interwoven with the support fingers with the corrugations alternatingly disposed inwardly and outwardly of the support fingers.

5. The toilet assembly as set forth in claim 3, wherein said support element has an annular configuration.

6. The toilet assembly as set forth in claim 1, wherein the locking ring is formed of metal.

7. The toilet assembly as set forth in claim 1, wherein said ring gasket comprises a wax seal.

8. A toilet assembly comprising:

a mounting surface defining an opening;

a waste pipe located in said opening of said mounting surface, said waste pipe having an end at a location no higher than flush with said mounting surface;

a toilet having a drain aligned with said waste pipe;

a ring gasket having at least a portion situated around said drain of said toilet; and a closet flange including:

a tubular portion having a proximal end and a distal end;

a flange portion located at said proximal end of said tubular portion, said flange portion being connected to said mounting surface;

said end of said waste pipe being received in said tubular portion of said closet flange such that an outer surface of said waste pipe is adjacent to an inner surface of said tubular portion;

a seal ring disposed between said inner surface of said tubular portion and said outer surface of said waste pipe, and a locking structure carried by said tubular portion of said closet flange, said locking structure including a plurality of inner edge portions spaced circumferentially about said inner surface of said tubular portion and engaging the outer surface of the waste pipe so as to inhibit axial separation of the closet flange and waste pipe;

wherein said locking structure comprises a locking ring that defines said plurality of inner edge portions, and said locking ring includes a plurality of corrugations extending circumferentially thereabout, the corrugations presenting said inner edge portions and outer edge portions engaging the inner surface of the tubular portion of the closet flange, and wherein said locking structure comprises a support element connected to said tubular portion of said closet flange, said support element being in assembly with said locking ring so as to support said locking ring in a predetermined disposition, and said support element has an annular configuration; and wherein tubular portion of said closet flange has a plurality of arcuate extensions received in corresponding slots defined in said support element to connect said support element and said tubular portion.

9. A closet flange for use in installation of a toilet in relation to a waste pipe, said closet flange comprising:

a unitary body formed of polymeric material, said body including a tubular portion having a proximal end and a distal end and a flange portion located at said proximal end of said tubular portion;

said flange portion extending radially outward with respect to said tubular portion of said unitary body and defining a plurality of openings therethrough for use in securing said closet flange to a mounting surface;

a seal ring disposed on an inner surface of said tubular portion to provide sealing engagement between said inner surface of said tubular portion and an outer surface of the waste pipe; and a locking structure carried by said tubular portion of said closet flange, said locking structure including a plurality of inner edge portions spaced circumferentially about said inner surface of said tubular portion and engaging the outer surface of the waste pipe so as to inhibit axial separation of the closet flange and waste pipe, and wherein said locking structure comprises a locking ring that defines said plurality of inner edge portions, and said locking ring includes a plurality of corrugations extending circumferentially thereabout, the corrugations presenting said inner edge portions and outer edge portions engaging the inner surface of the tubular portion of the closet flange.

10. The closet flange as set forth in claim 9, wherein said locking ring has a generally frusto-conical shape.

11. The closet flange as set forth in claim 10, wherein the corrugations of said locking ring extend at a conical angle of between about five degrees (5°) and about twenty-five degrees (25°).

12. The closet flange as set forth in claim 11, wherein the corrugations of said locking ring extend at a conical angle of about fifteen degrees (15°).

13. The closet flange as set forth in claim 9, wherein said locking structure comprises a support element connected to said tubular portion of said unitary body, said support element being in assembly with said locking ring so as to support said locking ring in a predetermined disposition.

14. The closet flange as set forth in claim 13, wherein said support element comprises a plurality of support fingers spaced apart circumferentially thereabout, the locking ring being interwoven with the support fingers with the corrugations alternatingly disposed inwardly and outwardly of the support fingers.

15. The closet flange as set forth in claim 13, wherein said support element has an annular configuration.

16. The closet flange as set forth in claim 9, wherein the locking ring is formed of metal.

17. The closet flange as set forth in claim 9, wherein the plastic material from which said unitary body is formed is polyvinyl chloride.

18. The closet flange as set forth in claim 9, wherein said flange portion defines a pair of diametrically-opposed arcuate slots for receipt of a respective toilet bolt, said slots having a widened insertion portion and a narrow retaining portion.

19. A closet flange for use in installation of a toilet in relation to a waste pipe, said closet flange comprising:

a unitary body formed of polymeric material, said body including a tubular portion having a proximal end and a distal end and a flange portion located at said proximal end of said tubular portion;

said flange portion extending radially outward with respect to said tubular portion of said unitary body and defining a plurality of openings therethrough for use in securing said closet flange to a mounting surface;

a seal ring disposed on an inner surface of said tubular portion to provide sealing engagement between said inner surface of said tubular portion and an outer surface of the waste pipe; and a locking structure carried by said tubular portion of said closet flange, said locking structure including a plurality of inner edge portions spaced circumferentially about said inner surface of said tubular portion and engaging the outer surface of the waste pipe so as to inhibit axial separation of the closet flange and waste pipe;

wherein said locking structure comprises a locking ring that defines said plurality of inner edge portions and said locking ring includes a plurality of corrugations extending circumferentially thereabout, the corrugations presenting said inner edge portions and outer edge portions engaging the inner surface of the tubular portion of the closet flange;

wherein said locking structure comprises a support element connected to said tubular portion of said unitary body, said support element being in assembly with said locking ring so as to support said locking ring in a predetermined disposition and said support element has an annular configuration; and wherein tubular portion of said unitary body has a plurality of arcuate extensions received in corresponding slots defined in said support element to connect said support element and said tubular portion.

20. A closet flange for use in installation of a toilet in relation to a waste pipe, said closet flange comprising:

a unitary body formed of polymeric material, said body including a tubular portion having a proximal end and a distal end and a flange portion located at said proximal end of said tubular portion;

said flange portion extending radially outward with respect to said tubular portion of said unitary body and defining a plurality of openings therethrough for use in securing said closet flange to a mounting surface;

said flange portion further defining a pair of diametrically-opposed arcuate slots for receipt of a respective toilet bolt, said slots having a widened insertion portion and a narrow retaining portion;

a seal ring disposed on a surface of said tubular portion to provide sealing engagement with a surface of the waste pipe; and a locking structure carried by said tubular portion of said closet flange, said locking structure including a locking ring defining a plurality of edge portions spaced circumferentially about said surface of said tubular portion and engaging the surface of the waste pipe so as to inhibit axial separation of the closet flange and waste pipe;

wherein said locking ring includes a plurality of corrugations extending circumferentially thereabout, the corrugations presenting said inner edge portions and outer edge portions engaging the inner surface of the tubular portion of the closet flange.

21. The closet flange as set forth in claim 20, wherein an inner surface of said tubular portion of said unitary body has a smaller inner diameter proximal portion and a larger inner diameter distal portion, said seal ring and said locking ring being positioned at said distal portion so as to engage an outer surface of the waste pipe.

22. A method of installing a toilet to a mounting surface defining an opening at which an end of a waste pipe is located, said method comprising steps of:

(a) providing a closet flange including:

a tubular portion having a proximal end and a distal end;

a flange portion located at said proximal end of said tubular portion; and a seal ring and a locking ring disposed on an inner surface of said tubular portion, said locking ring defining a plurality of inner edge portions spaced circumferentially about said inner surface of said tubular portion; wherein said locking ring includes a plurality of corrugations extending circumferentially thereabout, the corrugations presenting said inner edge portions and outer edge portions engaging the inner surface of the tubular portion of the closet flange;

(b) slidably positioning said tubular portion of said closet flange on an outer surface of said waste pipe until said flange portion engages the mounting surface such that the seal ring and the edge portions of the locking ring engage the outer surface of the waste pipe to inhibit axial separation of said closet flange and said waste pipe;

(c) securing said flange portion of said closet flange to said mounting surface;

(d) positioning a ring gasket at a drain opening defined in said flange portion of said closet flange; and (e) positioning the toilet with respect to the mounting surface such that a drain of the toilet will be circumscribed by said ring gasket.

23. The method as set forth in claim 22, wherein said flange portion of said closet flange defines a pair of diametrically-opposed arcuate slots for receipt of a respective toilet bolt, said slots having a widened insertion portion and a narrow retaining portion, and the method further comprises positioning a respective toilet bolt in each of said arcuate slots.

* * * * *